US010612369B2

(12) United States Patent
Dufour et al.

(10) Patent No.: US 10,612,369 B2
(45) Date of Patent: Apr. 7, 2020

(54) LOWER COMPLETION COMMUNICATION SYSTEM INTEGRITY CHECK

(71) Applicant: Schlumberger Technology Corporation, Sugar Land, TX (US)

(72) Inventors: Yann Dufour, Montrouge (FR); Benoit Deville, Houston, TX (US); Marian Faur, Palaiseau (FR); Hy Phan, Houston, TX (US); Debasmita Basak, Pearland, TX (US); John Algeroy, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 88 days.

(21) Appl. No.: 15/115,892

(22) PCT Filed: Feb. 2, 2015

(86) PCT No.: PCT/US2015/014063
§ 371 (c)(1),
(2) Date: Aug. 1, 2016

(87) PCT Pub. No.: WO2015/117060
PCT Pub. Date: Aug. 6, 2015

(65) Prior Publication Data

US 2017/0167248 A1 Jun. 15, 2017

Related U.S. Application Data

(60) Provisional application No. 61/934,248, filed on Jan. 31, 2014.

(51) Int. Cl.
*E21B 43/12* (2006.01)
*E21B 47/12* (2012.01)
(Continued)

(52) U.S. Cl.
CPC ..... *E21B 47/12* (2013.01); *E21B 17/028* (2013.01); *E21B 43/12* (2013.01); *E21B 47/00* (2013.01); *E21B 43/14* (2013.01)

(58) Field of Classification Search
CPC ..... E21B 43/12; E21B 23/00; E21B 47/12
(Continued)

(56) References Cited

U.S. PATENT DOCUMENTS 5,542,472 A 8/1996 Pringle et al.
5,955,666 A * 9/1999 Mullins ..... E21B 23/02 340/853.1
(Continued)

FOREIGN PATENT DOCUMENTS

EP 0767863 A1 4/1997
RU 57816 U1 10/2006
(Continued)

OTHER PUBLICATIONS

International Search Report and the Written Opinion for International Application No. PCT/US2015/014063 dated May 29, 2015.
(Continued)

*Primary Examiner* — Kenneth L Thompson

(57) ABSTRACT

A technique facilitates verification of the integrity of a lower completion prior to deployment of a corresponding upper completion. A lower completion is initially deployed downhole into a wellbore and comprises a plurality of functional components, such as a sensor, a communication system, a flow control system, and/or other functional components. A service tool system is removably deployed into the wellbore and comprises a service tool with an interface which interacts with the lower completion. The interface enables verification of the integrity, e.g. functionality, of various functional components of the lower completion without the use
(Continued)

of an additional communication line, e.g. power cable, routed separately to the lower completion.

20 Claims, 2 Drawing Sheets

(51) Int. Cl.
*E21B 17/02* (2006.01)
*E21B 47/00* (2012.01)
*E21B 43/14* (2006.01)

(58) Field of Classification Search
USPC ..... 166/50, 272.7, 381
See application file for complete search history.

(56) References Cited

U.S. PATENT DOCUMENTS 6,768,700 B2 7/2004 Veneruso et al.
7,168,487 B2 1/2007 Salamitou et al.
7,191,832 B2 * 3/2007 Grigsby ..... E21B 17/026 166/278
7,866,414 B2 * 1/2011 Patel ..... E21B 47/12 166/205
8,910,716 B2 * 12/2014 Newton ..... E21B 43/12 166/191
8,988,178 B2 * 3/2015 Deville ..... E21B 17/028 336/115
9,309,761 B2 * 4/2016 Wood ..... E21B 47/12
9,926,769 B2 * 3/2018 Wood ..... E21B 34/066
9,945,203 B2 * 4/2018 Patel ..... E21B 43/12
2002/0114216 A1 8/2002 Veneruso et al.
2005/0072564 A1 * 4/2005 Grigsby ..... E21B 17/023 166/65.1
2009/0008078 A1 * 1/2009 Patel ..... E21B 34/10 166/50
2010/0231411 A1 9/2010 Tubel
2012/0152562 A1 * 6/2012 Newton ..... E21B 43/12 166/369
2013/0181799 A1 7/2013 Deville et al.
2013/0327572 A1 * 12/2013 Sponchia ..... E21B 41/0035 175/61

FOREIGN PATENT DOCUMENTS

RU 2338064 C1 11/2008
RU 2359120 C2 6/2009
RU 2374441 C2 11/2009
SU 920201 A1 4/1982
WO WO 2001073423 A1 10/2001
WO 2013055677 A2 4/2013
WO 2015117060 A1 8/2015

OTHER PUBLICATIONS

Russian Official Action for corresponding Russian Application Serial No. 2016135027/03, dated Aug. 22, 2017, 11 pages.
Russian Decision on Grant for corresponding Russian Application Serial No. 2016135027/03, dated Oct. 4, 2018, 17 pages.

* cited by examiner

LOWER COMPLETION COMMUNICATION SYSTEM INTEGRITY CHECK

CROSS-REFERENCE TO RELATED APPLICATIONS

The present document is based on and claims priority to U.S. Provisional Application Ser. No. 61/934,248 filed Jan. 31, 2014, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed to control and enhance the efficiency of producing the various fluids from the reservoir. One piece of equipment which may be installed is a lower completion having a lower completion communication system. An upper completion is then delivered downhole and connected with the lower completion. Prior to connection of the upper completion, difficulties can arise in verifying the integrity, e.g. functionality, of the communication system and other lower completion components especially if there is no power cable routed separately downhole to provide power to the lower completion system.

SUMMARY

In general, a system and methodology are provided for verifying the integrity of a lower completion prior to deployment of a corresponding upper completion. A lower completion is initially deployed downhole into a wellbore and comprises a plurality of functional components, such as a sensor, a communication system, a flow control system, and/or other functional components. A service tool system is removably deployed into the wellbore and comprises a service tool with an interface which interacts with the lower completion. The interface enables verification of the integrity, e.g. functionality, of various functional components of the lower completion without the use of an additional communication line, e.g. power cable, routed separately to the lower completion.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
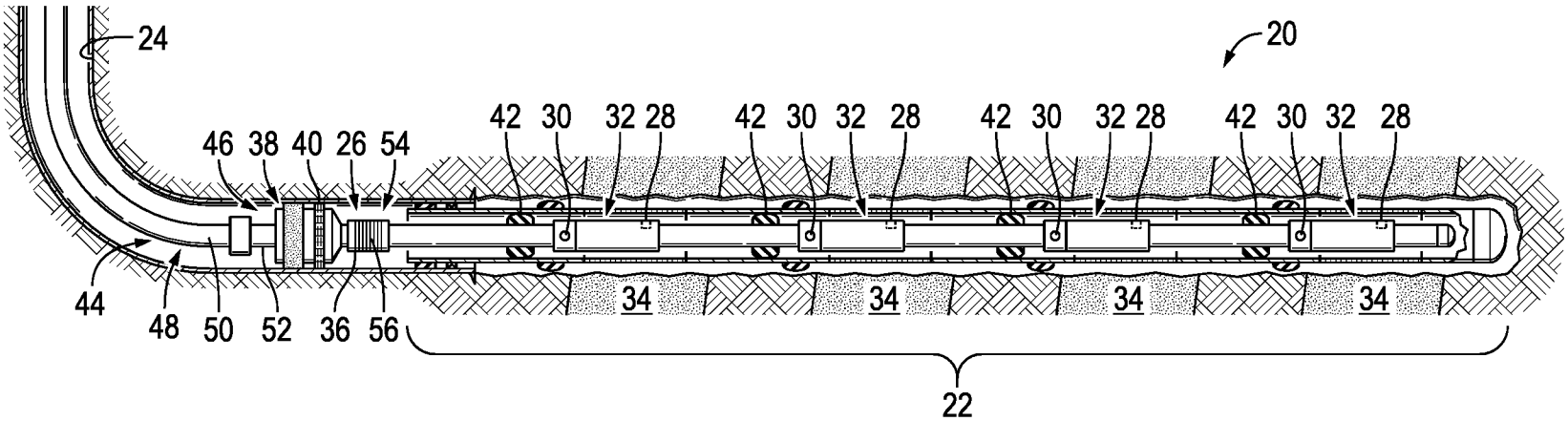
FIG. 1 is an illustration of an example of a well system having a lower completion deployed in a wellbore and interfacing with a service tool system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for facilitating verification of the integrity of a lower completion prior to deployment of a corresponding upper completion. In various embodiments, a lower completion is initially deployed downhole into, for example, a deviated wellbore section. The deviated wellbore section may comprise a long, horizontal wellbore section. The lower completion may comprise a wide variety of components to facilitate a production operation, a well treatment operation, and/or other well related operations. In some applications, the lower completion may comprise a variety of functional components such as a sensor, a communication system, a flow control system, and/or other functional components.

In some embodiments, the lower completion extends through a plurality of well zones and the lower completion may be constructed with a plurality of stages which correspond with the plurality of well zones. In such applications, each stage of the lower completion may comprise a plurality of functional components, such as sensors and/or flow control systems.

Once the lower completion is properly positioned downhole and prior to deployment of a corresponding upper completion, a service tool system is removably conveyed into the wellbore. The service tool system comprises a service tool with an interface which interacts with the lower completion. The interface enables verification of the integrity, e.g. functionality, of the various functional components of the lower completion without the use of an additional communication line, e.g. power cable, routed separately to the lower completion.

This capability can be particularly helpful when the lower completion is located at a substantial distance along a deviated, e.g. horizontal, wellbore because of the difficulties of routing power cables and/or other control lines down to the lower completion. For example, rotation of the service tool system may be desirable to enable movement over the substantial horizontal distance but such rotation can twist control lines to the point of breakage. Other methods of moving control lines, e.g. power cables, over substantial horizontal distances are also problematic. Thus, providing power and control signals to the lower completion to verify its integrity has proved to be difficult with existing systems and techniques.

In some embodiments of the present disclosure, a communication system may be installed as part of a lower completion system. The communication system may comprise a variety of components, e.g. at least one inductive coupler system, which enable the transmission of power and communication signals to and/or from the lower completion system. Generally, the communication system is constructed to function during the life of the well but removal of the communication system from the lower completion becomes very difficult once a corresponding upper completion is run downhole. However, the present system and methodology enables verification of the integrity, e.g. functionality, of lower completion components, including the communication system, during or soon after installation of the lower completion system. The system and methodology are useful in certain types of wells, including very deep or very long horizontal wells, e.g. extended reach drilling (ERD) wells. However, the system and methodology may be used in many types of wells, including vertical wells, deviated wells, e.g. horizontal or other deviated wells, single wellbore applications, multiple wellbore applications, or other well applications.

Referring generally to FIG. 1, an embodiment of a well system 20 is illustrated. In this example, well system 20 comprises a lower completion 22 which has been deployed downhole into a wellbore 24. The lower completion 22 may comprise a variety of functional components, such as a communication system 26, a sensor 28, and a flow control system 30. In many applications, the lower completion 22 comprises a plurality of stations or stages 32 which correspond with a plurality of well zones 34. Each of the stages 32 may comprise at least one of the sensor 28, flow control system 30, and/or other functional components. The communication system 26 enables communication of power and/or communication signals to and/or from the various functional components, e.g. sensors 28 and flow control systems 30. In the example illustrated, the communication system 26 comprises at least one inductive coupler component 36 through which signals, e.g. power and/or communication signals, are communicated.

In the illustrated embodiment, the lower completion 22 also comprises an uphole packer 38 with an anchor 40. The lower completion 22 may further comprise a plurality of isolation packers 42 used to separate stages 32 and thus to separate the corresponding well zones 34. Depending on the application, the lower completion 22 may comprise a variety of additional or other components including screens, valves, tubing sections, or other components selected and constructed to facilitate a given well operation.

The well system 20 also comprises a service tool system 44 which is removably deployed in wellbore 24 so as to enable verification of the integrity, e.g. functionality, of the various functional components including communication system 26, sensors 28, and/or flow control devices 30. The service tool system 44 comprises a service tool 46 conveyed downhole via a conveyance 48, such as a drill pipe 50 or coiled tubing. The service tool 46 comprises a corresponding communication system 52 having a service tool interface 54 which interfaces with the communication system 26 of lower completion 22. The interface 54 may utilize a corresponding inductive coupler component 56 which communicatively engages the inductive coupler component 36 of lower completion 22 to form an inductive coupler system 58.

Figure 2:
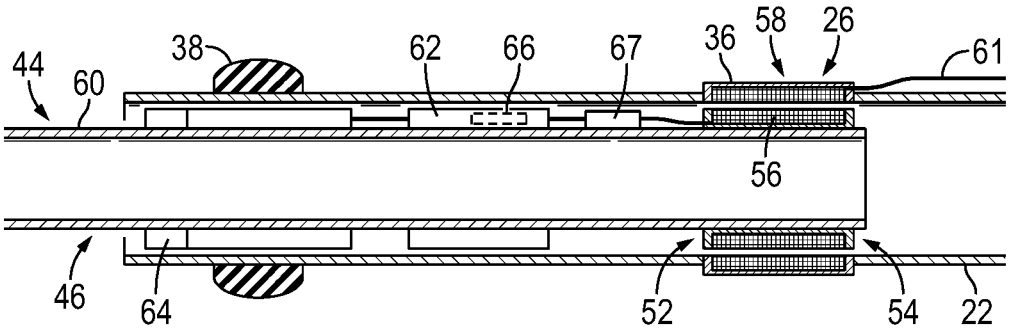
FIG. 2 is an illustration of an example of a service tool having a service tool interface which interfaces with a communication system of a lower completion, according to an embodiment of the disclosure.

Referring generally to FIG. 2, an embodiment of service tool 46 having service tool interface 54 is illustrated as interfacing with communication system 26 of lower completion 22. In this example, the service tool 46 is conveyed downhole via a conveyance 48, e.g. coiled tubing 60, until the inductive coupler component 56 of service tool 46 is engaged with the inductive coupler component 36 of the lower completion communication system 26. By way of example, inductive coupler component 36 may be in the form of a female coupler and the corresponding inductive coupler component 56 may be in the form of a male coupler. The inductive coupler component 36 may communicate power and/or data with a variety of lower completion components, e.g. sensors 28 and flow control devices 30, over a suitable communication line 61 during verification of lower completion integrity.

In the embodiment illustrated, the service tool 46 further comprises a measurement-while-drilling (MWD) tool 62. The MWD tool 62 may be employed, for example, to help verify the integrity of the communication system 26, sensors 28, and/or control system 30 of lower completion 22. For example, the MWD tool 62 may be operated to test the functional components of the lower completion 22 prior to removal of the service tool system 44 and the subsequent running downhole of an upper completion. In this type of embodiment, the MWD tool 62 may be used to receive communication signals from the surface and to send communication signals to the surface via a telemetry system 64, such as a mud pulse telemetry system or other wireless telemetry system. The MWD tool also may comprise a power source 66, e.g. downhole battery, used to provide power to the inductive coupler system 58 during testing and verification of the integrity, e.g. operational capability, of lower completion 22. The power source 66 also may provide power for enabling communication of signals through lower completion coupler component 36 and to or from the various functional components of lower completion 22, e.g. sensors 28 and flow control devices 30 during the verification procedure.

The service tool 46 also may comprise a memory 67 for capturing data during installation downhole in wellbore 24. In some applications, the memory 67 and capture data can be retrieved and downloaded for analysis once the service tool 46 is retrieved back to the surface. Power source 66 and/or other suitable power sources, e.g. battery packs, may be used to provide sufficient power to the memory 67 during the downhole installation period. In some applications, the memory 67 may be used to store data for later transmission uphole. For example, if the MWD tool 62 or other system has a limited baud rate with respect to data transmission, the data may be stored in memory 67 for later transmission uphole and/or for later downloading following retrieval of the service tool 46 to the surface. In various embodiments, memory 67 is useful for storing data during certain processes such as circulation and communication from surface. It should be noted that memory 67 may be incorporated into a variety of embodiments including the MWD embodiment illustrated in FIG. 2 as well as the other embodiments illustrated and described herein.

In some applications where MWD operations are limited or not feasible, the memory 67 may be constructed to record continuously or at set intervals. This enables verification of system integrity when the service tool is retrieved to the surface. Thus, recovery time is significantly reduced in case of, for example, system failure. Some applications may utilize memory 67 without MWD tool 62 to simply enable capture of data during installation downhole. The captured data is subsequently downloaded upon retrieval of service tool 46 to the surface.

Depending on the application, the MWD tool 62 may be incorporated into service tool 46 to enable performance of a variety of functions. For example, the MWD tool 62 can be used to provide power to the lower completion and to provide telemetry to the surface during the testing and verification process. In some applications, the MWD tool 62 also may be utilized as an intelligent packer service tool. Sometimes, the MWD tool 62 may be used to provide a coupler cartridge constructed to provide conversion of signals from one protocol to another (e.g. from low power tool bus (LTB) protocol to WellNet™ protocol) and/or for conducting test scenarios with respect to the lower completion 22. WellNet™ protocol is available from Schlumberger Technology Corporation in a variety of downhole communication systems.

Figure 3:
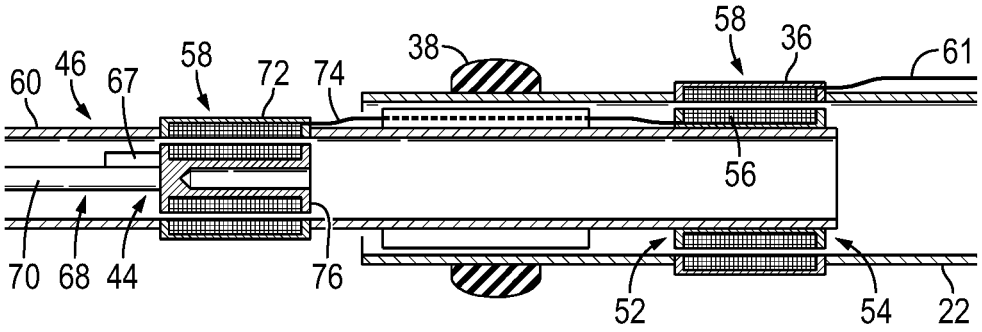
FIG. 3 is an illustration of another example of a service tool having a service tool interface which interfaces with a communication system of a lower completion, according to an embodiment of the disclosure.

In some applications, an electrical coiled tubing system 68 may be employed to test the communication system 26, sensors 28, and/or flow control devices 30 of lower completion 22. An embodiment of the service tool 46 employing an example of the electrical coiled tubing system 68 is illustrated in FIG. 3. In this example, the electrical coiled tubing system 68 receives communication from the surface and provides communication to the surface via a signal carrier 70, e.g. a communication line, disposed within the coiled tubing 60. For example, the communication line 70 may be positioned along the open interior of the coiled tubing 60 or within a wall of the coiled tubing 60. By way of example, the communication line 70 may comprise an electrical line or fiber optic line. Combining the communication line 70 with the coiled tubing 60 provides signal and/or power communication with the lower completion 22 without running a separate cable downhole. As with other embodiments described herein, verification of lower completion integrity may be accomplished without use of a communication line, e.g. power cable, conveyed downhole to the lower completion 22 in a separate operation.

In the example illustrated in FIG. 3, a plurality of inductive coupler systems 58 is utilized for communicating signals to and from the lower completion 22. For example, inductive coupler component 56 may be used as the service tool interface 54 for communicating with the inductive coupler component 36 of lower completion 22. However, the inductive coupler component 56 communicates with a female inductive coupler component 72 via a suitable communication line 74. In this example, the female inductive coupler component 72 is mounted to coiled tubing 60 and communicates with a corresponding male inductive coupler component 76 connected with communication line 70. The female inductive coupler component 72 and the corresponding male inductive coupler component 76 form the second inductive coupler system 58. Signals, e.g. power and/or communication signals, are communicated between the lower completion 22 and the service tool system 44 via both of these inductive coupler systems 58. Communication between the service tool system 44 and the lower completion 22 enables testing of the lower completion communication system 26 and other lower completion functional components prior to running of an upper completion downhole into engagement with lower completion 22.

By using the electrical coiled tubing system 68, high-speed communication of signals may be achieved. For example, high-speed signals may be transmitted to and from the surface via the communication line 70, e.g. electric line, fiber optic line, or other communication line, routed within the exterior of coiled tubing 60. In some applications, the electrical coiled tubing system 68 also may comprise various modems or other communication equipment, e.g. a WellNet™ modem. Depending on the application, power may be provided from the surface; or a downhole power source 66, e.g. battery, may be provided in the electrical coiled tubing system 68.

Figure 4:
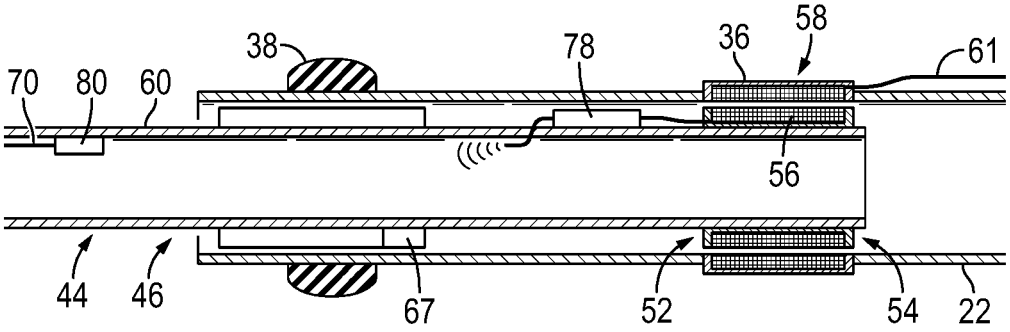
FIG. 4 is an illustration of another example of a service tool having a service tool interface which interfaces with a communication system of a lower completion, according to an embodiment of the disclosure.

Referring generally to FIG. 4, another embodiment of service tool 46 having service tool interface 54 is illustrated as interfacing with communication system 26 of a lower completion 22. In this example, the service tool 46 is conveyed downhole via coiled tubing 60 and comprises electrical coiled tubing system 68. However, this embodiment of electrical coiled tubing system 68 employs a wireless communication device 78 to convey signals from the service tool interface 54, e.g. inductive coupler component 56, to an uphole position for transmission to the surface. For example, the wireless communication device 78 may be used to convey signals wirelessly to or from a corresponding telemetry device 80 mounted along coiled tubing 60. However, the wireless communication device 78 also can be used to communicate with telemetry device 80 positioned on a wireline deployed tractor system. This latter type of embodiment would enable verification of the integrity, e.g. functionality, of the lower completion communication system 26, sensors 28, flow control devices 30, and/or other functional components without utilizing tubing in the service tool system 44. In these embodiments, the wireless communication device 78 would still be able to communicate with components of the lower completion 22 via inductive coupler component 36.

Depending on the application, the well system 20 and the lower completion 22 may have a variety of configurations and may comprise numerous types of components. Additionally, various sensors, flow control devices, and other devices may be utilized in one or more stages along the lower completion 22. Also, the procedures for testing the lower completion 22 and for verifying the integrity, e.g. functionality, of the various components of lower completion 22 may be adjusted according to the parameters of a given wellbore, completion system, and/or reservoir. Similarly, the service tool system 44 may be constructed in a variety of configurations with numerous types of components to facilitate preliminary testing of the lower completion 22 to ensure the lower completion 22 is ready to receive a corresponding upper completion. Numerous types of upper completion also may be deployed downhole and into engagement with the lower completion 22 depending on the parameters of a given well application, wellbore, and/or surrounding formation.

In the various applications and embodiments described herein, short "messages" may be sent to trigger events or series of events downhole at, for example, stages 32. However, the events may vary from one application to another. In some applications, the messages sent downhole enable operations of valves collectively or individually. By way of example, the valves may be actuated from fully open to fully closed positions, from fully closed to fully open positions, and/or to desired positions in between as predefined on, for example, appropriate firmware. Depending on the application, the messages sent downhole may be applied to enable various other events or series of events. In some applications, the messages may be stored, e.g. stored in memory 67, and then sent from a downhole location to trigger the desired events at, for example, stages 32. Whether the messages are sent from a surface location or from a downhole location, the messages are sent to or through the tool 62 and then through the corresponding inductive coupler system to enable the desired operations of valves and/or other components.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a lower completion initially deployed in a wellbore without an upper completion, the lower completion comprising a sensor, a communication system, and a flow control system;

an uphole packer positioned uphole of the lower completion, the uphole packer comprising an anchor; and a service tool system removably deployed in the wellbore, the service tool system having a service tool system interface which interfaces with the lower completion when there is no upper completion positioned downhole, the service tool system interfacing with the lower completion to verify a functionality of at least one of the sensor, the communication system, and the flow control system without use of a communication line routed separately to the lower completion and with no upper completion connected to the lower completion.

2. The system as recited in claim 1, wherein the lower completion is deployed in a horizontal wellbore section.

3. The system as recited in claim 1, wherein the lower completion comprises a plurality of stages, each stage having a sensor and a flow control system, the plurality of stages separated by a plurality of isolation packers.

4. The system as recited in claim 1, wherein the service tool system comprises a conveyance in the form of a drill string.

5. The system as recited in claim 1, wherein the service tool system comprises a conveyance in the form of coiled tubing.

6. The system as recited in claim 1, wherein the communication system comprises an inductive coupler component.

7. The system as recited in claim 1, wherein the service tool system comprises a service tool having a service tool interface which communicates with the communication system of the lower completion.

8. The system as recited in claim 1, wherein the service tool interface comprises an inductive coupler component.

9. The system as recited in claim 8, wherein the service tool system comprises a measurement-while-drilling tool.

10. A method for verifying functionality of a lower completion, comprising:

deploying a lower completion downhole into a wellbore;

conveying a service tool system downhole into the wellbore;

coupling the service tool system with the lower completion via an inductive coupler system;

providing power and communication signals through the inductive coupler system without separately routing a communication line downhole;

testing and verifying functionality of a plurality of components of the lower completion during installation of the lower completion, via signals communicated through the inductive coupler system, without having a corresponding upper completion positioned in the wellbore; and retrieving the service tool system to the surface.

11. The method as recited in claim 10, wherein conveying comprises conveying via drill pipe.

12. The method as recited in claim 10, wherein conveying comprises conveying via coiled tubing.

13. The method as recited in claim 12, further comprising transmitting signals along a signal carrier disposed in the coiled tubing.

14. The method as recited in claim 10, further comprising transmitting signals wirelessly along the service tool system.

15. The method as recited in claim 10, wherein verifying comprises verifying the functionality of a plurality of sensors and a plurality of flow control systems.

16. The method as recited in claim 10, wherein coupling comprises utilizing a plurality of inductive coupler systems.

17. The method as recited in claim 10, wherein providing comprises utilizing a measurement-while-drilling tool to transmit signals.

18. A method, comprising:

positioning a lower completion in a deviated portion of a wellbore;

conveying a service tool downhole into the wellbore via a tubing string;

coupling the service tool to the lower completion via an inductive coupler system;

verifying functionality of a plurality of components of the lower completion during installation of the lower completion, via signals transmitted through the inductive coupler system, without having a corresponding upper completion engaged with the lower completion;

providing power to components of the plurality of components, while verifying functionality, via a downhole electric power supply.

19. The method as recited in claim 18, wherein conveying comprises conveying the service tool via drill pipe.

20. The method as recited in claim 18, further comprising withdrawing the service tool from the wellbore following verifying of the functionality.

* * * * *